US010894290B1

(12) United States Patent
Marshall et al.

(10) Patent No.: US 10,894,290 B1
(45) Date of Patent: Jan. 19, 2021

(54) OXIDATION RESISTANCE OF MOLYBDENUM SILICON BORIDE COMPOSITE

(71) Applicants: Peter E. Marshall, Perrysburg, OH (US); Carol Ann M. Wedding, Toledo, OH (US); Oliver M. Strbik, III, Holland, OH (US)

(72) Inventors: Peter E. Marshall, Perrysburg, OH (US); Carol Ann M. Wedding, Toledo, OH (US); Oliver M. Strbik, III, Holland, OH (US)

(73) Assignee: Trelleborg Applied Technologies, Toledo, OH (US)

( * ) Notice: Subject to any disclaimer, the term of this patent is extended or adjusted under 35 U.S.C. 154(b) by 0 days.

(21) Appl. No.: 16/831,310

(22) Filed: Mar. 26, 2020

Related U.S. Application Data

(63) Continuation of application No. 16/004,463, filed on Jun. 11, 2018, now abandoned, which is a continuation-in-part of application No. 14/717,603, filed on May 20, 2015, now Pat. No. 9,994,937.

(60) Provisional application No. 62/000,739, filed on May 20, 2014.

(51) Int. Cl.

| | |
|---|---|
| ***B22F 3/16*** | (2006.01) |
| ***B22F 9/04*** | (2006.01) |
| ***B22F 9/02*** | (2006.01) |
| ***C22C 1/05*** | (2006.01) |
| ***C22C 32/00*** | (2006.01) |

(52) U.S. Cl.
CPC ..... *B22F 3/16* (2013.01); *B22F 9/026* (2013.01); *B22F 9/04* (2013.01); *C22C 1/058* (2013.01); *C22C 32/0073* (2013.01); *B22F 2009/043* (2013.01); *B22F 2302/35* (2013.01); *B22F 2998/10* (2013.01)

(58) Field of Classification Search
CPC .... B22F 3/16; B22F 9/026; B22F 9/04; B22F 2009/043; B22F 2302/35; B22F 2998/10; C22C 1/058; C22C 32/0073
See application file for complete search history.

(56) References Cited

U.S. PATENT DOCUMENTS

2009/0011266 A1* 1/2009 Cochran ..... C22C 1/0491 428/545

* cited by examiner

*Primary Examiner* — Anthony J Zimmer
*Assistant Examiner* — Ricardo D Morales
(74) *Attorney, Agent, or Firm* — Donald K. Wedding

(57) ABSTRACT

Molybdenum composites containing silicon and boron for environmental resistance are combined so as to minimize the silicon solid solution in the molybdenum phase. The composites include ratios of molybdenum, silicon, and boron to form three phase mixtures of molybdenum, A15 ($Mo_3Si$), and T2 ($Mo_5SiB_2$) or molybdenum, $SiO_2$, and T2 ($Mo_5SiB_2$). Beneficial additives, including manganese and strontium aluminosilicate, are included to improve the composite's properties. Manufacturing processes to produce these composites as either powders or solid parts are included.

20 Claims, 12 Drawing Sheets

OXIDATION RESISTANCE OF MOLYBDENUM SILICON BORIDE COMPOSITE

RELATED APPLICATION

This application is a continuation under 35 U.S.C. 120 of U.S. patent application Ser. No. 16/004,463, filed Jun. 11, 2018 which is a division and continuation-in-part under 35 U.S.C. 120 of U.S. patent application Ser. No. 14/717,603, filed May 20, 2015 to issue as U.S. Pat. No. 9,994,937, on Jun. 12, 2018, which claims priority under 37 C.F.R. 119(e) of U.S. Provisional Patent Application Ser. No. 62/000,739 filed May 20, 2014, both incorporated herein by reference.

BACKGROUND OF INVENTION

Superalloys are used in demanding applications such as aerospace, heat treating furnaces, land based gas turbines, oil and gas industries, tool manufacturing, automotive, marine engineering, fossil fuel and nuclear generation plants, paper processing and food processing industries. Materials used in such an application must withstand elevated temperature in the presence of oxygen, vibration, shock, and stress. This invention relates to molybdenum silicon boride (Mo—Si—B) alloys and composites as a replacement for superalloys.

As commonly defined an alloy is a homogeneous mixture or solid solution of two or more metals, the atoms of one replacing or occupying interstitial positions between the atoms of the other. A composite is a combination of two or more materials (reinforcing constituents, fillers, and composite matrix binder) differing in form or composition. The composite constituents retain their identities, that is, they do not dissolve or merge completely into one another although they act in concert. Normally, the components can be physically identified and exhibit an interface between one another. The subject of this invention relates to a molybdenum matrix composite having boron and silicon based constituents (Mo—Si—B composite) and method of manufacture.

Mo—Si—B Alloy Prior Art

Mo—Si—B alloys have been disclosed in the prior art. A 1600° C. isothermal section of a Mo—Si—B ternary phase diagram 118 is shown in FIG. 8. The desired properties of high temperature applications such as turbine blades may be found in Mo—Si—B compositions in the molybdenum rich corner 119 of the phase diagram 118. This region includes three phases of matter: molybdenum solid solution ($Mo_{ss}$) and two intermetallic phases-$Mo_3Si$ (referred to by those of skill in the metallurgical and ceramic arts as "A15") and $Mo_5SiB_2$ (referred to as "T2"). These three phases have melting points above 2000° C. and the phase field is stable down to room temperature, making these alloys excellent candidates for high temperature structural use. The fracture toughness of the intermetallic phases may be improved by the presence of the more ductile molybdenum phase.

A variety of methods for producing Mo—Si—B alloys have emerged. To achieve high strength and fracture toughness, the alloys must be processed in a manner that creates a continuous molybdenum matrix. In addition, a fine dispersion of the Mo—Si—B intermetallic phases is necessary to generate a continuous protective glass layer. Much of the research has focused on melt-based processing or consolidation of pre-alloyed powders formed by inert gas atomization. Molybdenum has the highest melting point of the three phases in the alloy, causing primary solidification of the molybdenum solid solution. The resulting microstructures produced by these methods are coarse grained with isolated molybdenum regions. Prior art Mo—Si—B alloys are brittle at temperatures below 1000° C. and thus have limited application.

U.S. Pat. No. 5,693,156 (Berczik) describes a molybdenum alloys defined by the compositional points of the phase diagram for a ternary system: metal—1.0% Si—0.5% B, metal—1.0% Si—4.0% B, metal—4.5% Si—0.5% B, and metal—4.5% Si—4.0% B; wherein percentages are weight percents and wherein said metal consists essentially of molybdenum as the major component.

U.S. Pat. No. 6,652,674 (Woodard et al.) describes addition of minor components to Mo—Si—B alloys such as Fe, Ni, Co and Cu to improve oxidation resistance.

U.S. Pat. No. 7,005,191 (Perepezko et al.) discloses multiphase intermetallic materials composed of molybdenum silicides including a multiphase, multilayered oxidation resistant structure comprising: Mo—Si—B alloy substrate with a multiphase protective coating.

U.S. Patent Application Publication Serial No. 2006/0169369 (Jehanno) describes an Oxide Dispersion Strengthened (ODS) Mo—Si—B alloy, comprising: intermetallic phases molybdenum silicide and molybdenum boron silicide, and an optional component of molybdenum boride, with a total content of intermetallic phase constituents amounting to 25% to 90% by volume and a proportion of further microstructural constituents amounting to less than 5% by volume; an amount of 0.1%-5% by volume of one or more oxides or mixed oxides with a vapor pressure at 1500° C. of less than 5×10-2 bar; and a remainder of molybdenum or molybdenum solid solution. Oxides may be added to the Mo—Si—B alloy to increase the strength, and to improve the ductility properties. Preferred oxides include: $Y_2O_3$, $ZrO_2$, $HfO_2$, $TiO_2$, $Al_2O_3$, CaO, MgO and SrO.

Mo—Si—B Alloys and Composites Fabrication Method

A variety of methods for producing Mo—Si—B alloys have emerged. To achieve high strength and fracture toughness, the alloys must be processed in a manner that essentially creates a continuous molybdenum matrix. In addition, a fine dispersion of the Mo—Si—B intermetallic phases, is necessary to generate a continuous protective glass layer. With the exception of methods disclosed in U.S. Patent Application Publication No. 2009/0011266 (Cochran et al.), much of the research has focused on melt-based processing or consolidation of pre-alloyed powders formed by inert gas atomization. Molybdenum has the highest melting point of the three phases in the alloy, so these methods necessarily result in molybdenum primary solidification. The resulting microstructures produced by these methods are coarse grained with isolated molybdenum regions.

U.S. Pat. No. 5,595,616 (Berczik) describes a process for fabricating Mo—Si—B alloys in which elemental molybdenum, silicon and boron, in defined proportions are combined in a melt. Alloy from the melt is rapidly solidified into a fine powder. The powder is extruded at 1500° C. The extruded powder is swaged at 1370° C. with all heat treatments done in an inert atmosphere, in vacuo, or in hydrogen.

U.S. Pat. No. 7,560,138 (Perepezko et al.) describes a method for producing an oxidation resistant multi-layered structure, by exposing an Mo—Si—B alloy substrate or a substrate having an Mo—Si—B alloy surface character to a vapor comprising silicon and annealing the substrate to form a layer of MoSi 2 on the substrate; and annealing the $MoSi_2$ layer to produce an outer borosilicate layer, an intermediate layer comprising molybdenum disilicides, molybdenum silicides, or combinations thereof, and an inner borosilicide layer, wherein the inner borosilicide layer is integrated with the substrate.

U.S. Patent Application Publication No. 2006/0169369 (Jehanno) describes an Oxide Dispersion Strengthened Mo—Si—B fabricated by mechanical alloying and compacted at temperatures in the range from 1300° C.-1500° C.

U.S. Patent Application Publication No. 2009/0011266 (Cochran et al.) describes a method of making a molybdenum, molybdenum silicide and molybdenum silicon boride composite material, in which a boron nitride powder, a silicon nitride powder and a molybdenum powder are mixed to form a composite precursor. The composite precursor is sintered in an atmosphere consisting essentially of hydrogen and an inert gas to form a sintered material. The sintered material is hot isostatic pressed to form the composite material into a final shape.

DETAILED DESCRIPTION OF THE DRAWINGS

This invention relates to a low temperature process that controls the formation of molybdenum solid solution ($Mo_{ss}$) and allows for fabrication of novel Mo—Si—B composites not possible or envisioned by the prior art. Further disclosed is one or more additives that improve high temperature oxidation resistance, glass formation, ductility.

Molybdenum composites containing silicon and boron for environmental resistance are combined so as to minimize the silicon solid solution in the molybdenum phase. The composites include ratios of molybdenum, silicon, and boron to form three phase mixtures of molybdenum, A15 ($Mo_3Si$), and T2 ($Mo_5SiB_2$) or molybdenum, $SiO_2$, and T2 ($MosSiB_2$). Beneficial additives, including manganese and strontium aluminosilicate, are included to improve the composite's properties. Manufacturing processes to produce these composites as either powders or solid parts are included.

One process allows for the separate fabrication of beneficial intermetallics or other components which are combined with pure molybdenum to form a ductile, high temperature, oxidation resistant composite.

To achieve ductility at room temperature it is desirable to control the formation of molybdenum solid solution ($Mo_{ss}$). This is not possible with prior art melt process or powder process which require temperatures in excess of 1500° C. to form the desirable intermetallics, for example $Mo_3Si$ (A15) and $Mo_5SiB_2$(T2). Typically molybdenum, silicon, boron, or compounds thereof are mixed and heated at a high temperature. During the process, an equilibrium distribution of molybdenum, silicon, and boron are naturally formed as defined by the molybdenum, silicon, boron ternary phase diagram. $Mo_{ss}$ is formed along with various beneficial intermetallics.

The Mo—Si—B fabrication method disclosed U.S. Patent Application Publication No. 2009/0011266 is relatively simple and low cost. However, it suffers from the same problem as other Mo—Si—B fabrication methods in that during high temperature processing, above about 1500° C., molybdenum solid solution ($Mo_{ss}$) of about 1.5 to 2.0 atomic percent of silicon is formed. This and other processes result in a Mo—Si—B composition that has a ductile to brittle transition temperature (DBTT) of about 1200° C. This means that below 1200° C., the material is brittle. Additional process refinements and additives such as zirconium may reduce the DBTT from about 800° C. to 1000° C. However, because the Mo—Si—B alloy is brittle at room temperature, it has limited commercial use. For example higher concentrations A15 and T2 with respect to the molybdenum matrix will result in higher strength and better oxidation resistance. Lower concentrations of these two phases with respect to the molybdenum matrix will result in a more ductile composite.

Figure 1:
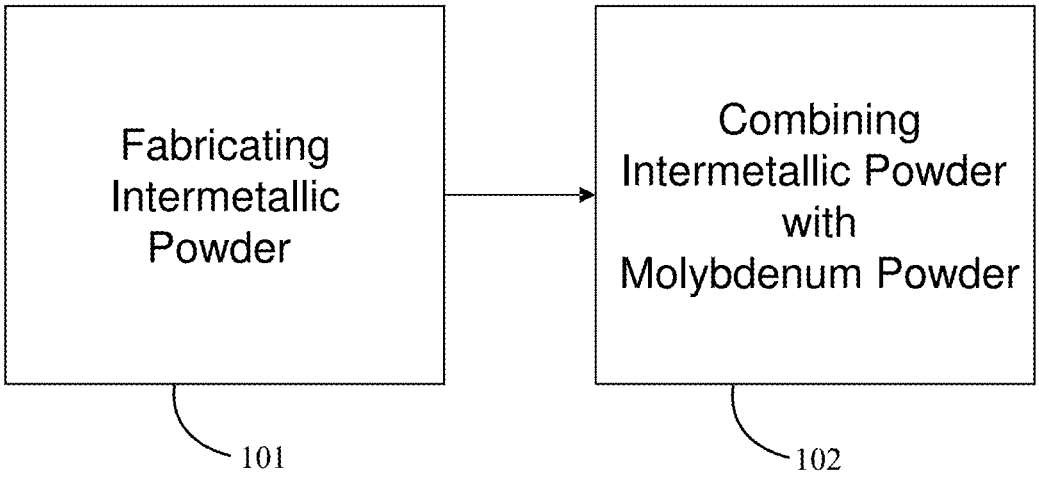
FIG. 1 is a block diagram illustrating the fabricating and combining of intermetallic powder with molybdenum powder.

In one embodiment, there is provided a process for controlling the formation of $Mo_{ss}$ by separately preparing particles of selected intermetallics and combining them with pure molybdenum as shown in FIG. 1. This allows for the selected intermetallics to be formed at a high temperature in step 101 and the intermetallics combined with molybdenum at a lower temperature in step 102. The steps of FIG. 1 may be accomplished using nitride precursor powder processing techniques as described herein.

Figure 2:
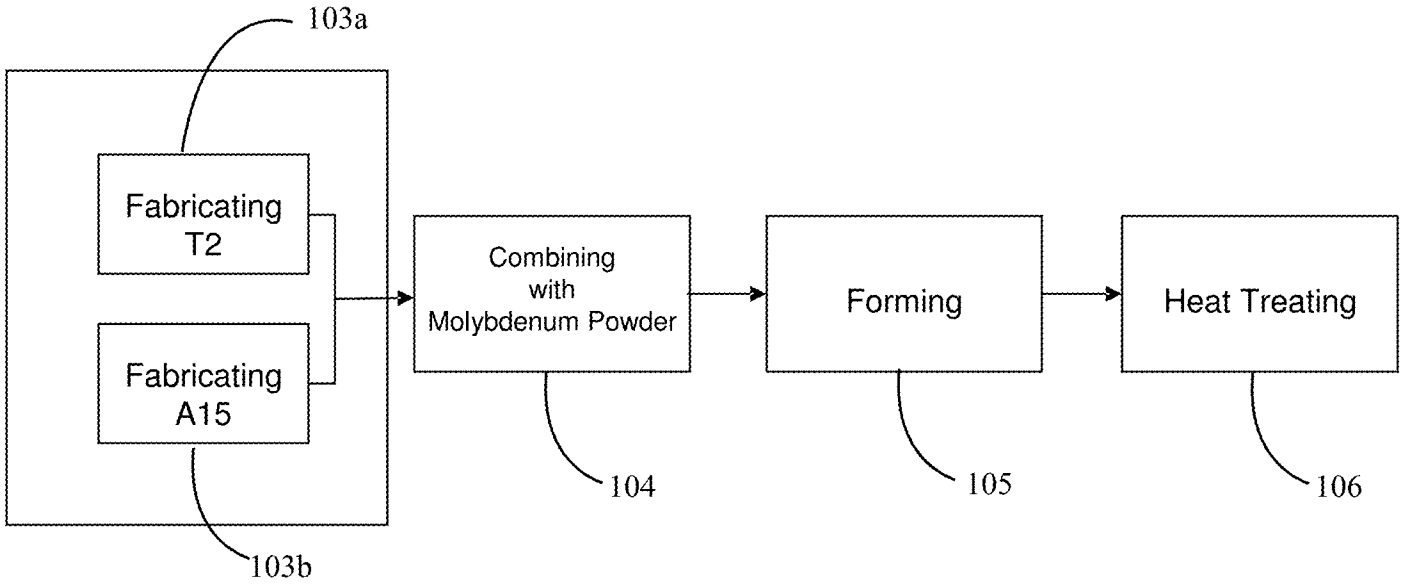
FIG. 2 is a block diagram illustrating the combining process of $Mo_5SiB_2$ (T2), $Mo_3Si$ (A15), and molybdenum powders.

In a preferred embodiment, intermetallic phases T2 and A15 are formed in two separate process steps 103*a* and 103*b* as shown in FIG. 2. In one specific embodiment, both T2 and A15 are formed together in the same step. In the T2 103*a* forming process step of FIG. 2, submicron sized powders of silicon nitrides, boron nitrides, and molybdenum are combined in the presence of heat with the following reaction:

$$5Mo + \frac{1}{3}Si_3N_4 + 2BN \rightarrow Mo_5SiB + \frac{5}{3}N_2$$

The composite precursors of T2 may be milled prior to the sintering action to break up agglomerates of the boron nitride powder, the silicon nitride powder, and the molybdenum powder. The silicon nitride powder and the molybdenum powder may be mixed with an organic or inorganic liquid such as acetone or water to form a suspension. An organic dispersant and binder, such as a methyl methacrylate polymer, may be added to the suspension. A lubricant, such as stearic acid, may also be added to the suspension. The suspension may be spray dried to form a homogenous powder mixture. The homogenous powder mixture is fired at a temperature sufficient to complete the reaction. This includes temperatures above 1100° C. with temperatures above 1500° C. being preferred.

In the A15 forming step 103*b* of FIG. 2, submicron sized powders of silicon nitrides and molybdenum are combined in the presence of heat with the following reaction:

$$3Mo + \frac{1}{3}Si_3N_4 \rightarrow Mo_3Si + \frac{2}{3}N_2$$

The composite precursor of A15 may be milled prior to the sintering action to break up agglomerates of the boron nitride powder, the silicon nitride powder and the molybdenum powder. The silicon nitride powder and the molybdenum powder may be mixed with a liquid (such water, acetone, or other organic or inorganic liquid) to form a suspension. An organic dispersant and binder, such as a methyl methacrylate polymer, may be added to the suspension. A lubricant, such as stearic acid, may also be added to the suspension. The suspension may be spray dried to form a homogenous powder mixture. The homogenous powder mixture is fired at temperatures sufficient to complete the reaction. This includes temperatures above 1000° C. with temperatures above 1500° C. being preferred.

In the combining process 104 of FIG. 2, T2, A15, and molybdenum powders are combined. This composition may be ball milled to break up agglomerates. The powder may be mixed with a liquid (such as water, acetone, or other organic or inorganic liquid) to form a suspension. An organic dispersant and binder, such as a methyl methacrylate copolymer, may be added to the suspension. A lubricant, such as stearic acid, may also be added to the suspension. The suspension may be spray dried to form a homogenous powder mixture. The powder mixture may be sintered at temperature below 1400° C., more preferably at or below 1300° C., which will greatly reduce the silicon concentration in the $Mo_{ss}$ present. The sintered powder may be subsequently processed to form parts.

Alternatively, prior to sintering the spray dried powder may be pressed in step 105 to form a shape, sintered and Hot Isostatic Pressed in step 106. Sintering and Hot Isostatic Pressing at temperatures below 1400° C., more preferably at or below 1300° C., will greatly reduce the silicon concentration in the $Mo_{ss}$ present.

Figure 3A:
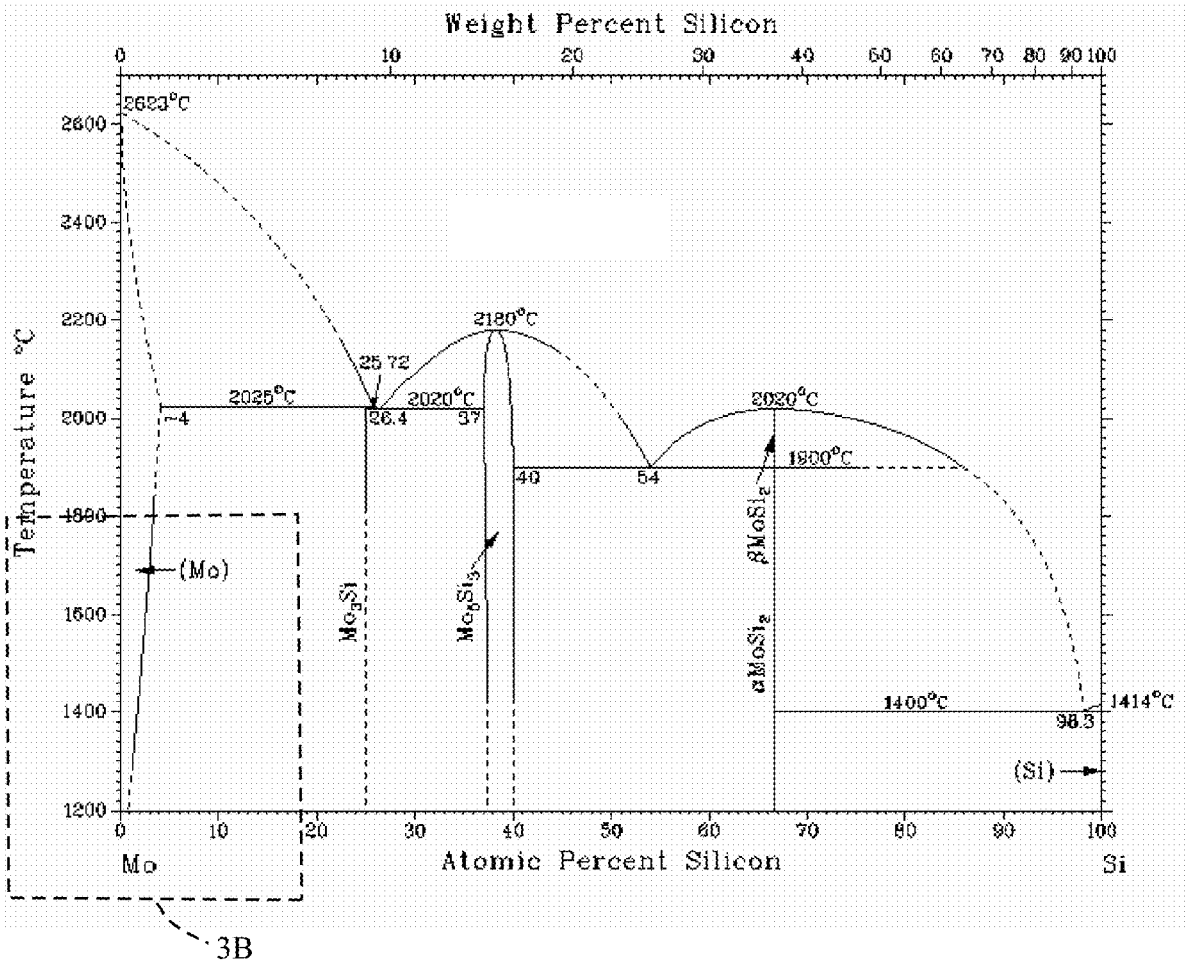
FIG. 3A shows a phase diagram of molybdenum and silicon.
Figure 3B:
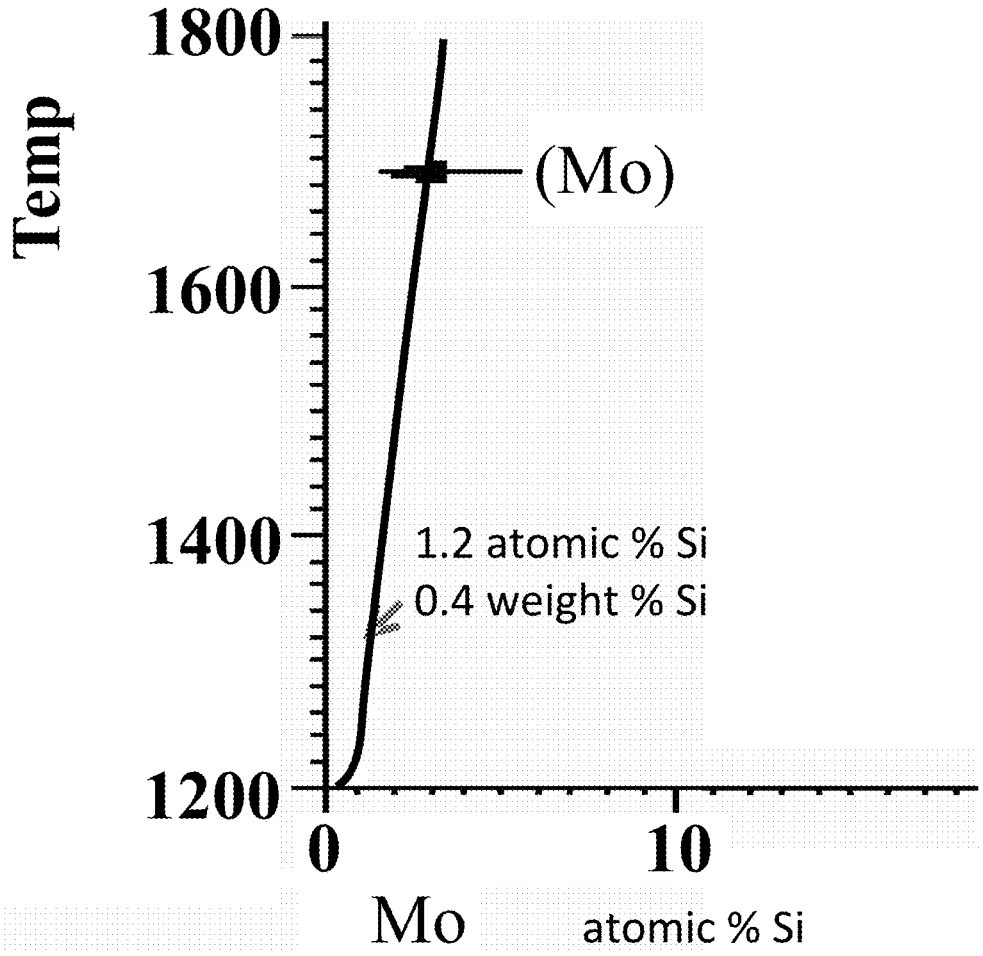
FIG. 3B shows a closer view of the origin of the phase diagram in FIG. 3A.

FIG. 3A shows a phase diagram of molybdenum and silicon. FIG. 3B shows a closer view of the origin. It may be seen from these diagrams that if sintering temperatures are kept below about 1400° C., less than 3 atomic percent silicon, typically about 2 atomic percent silicon will form a solution with molybdenum. If the sintering temperatures are near or below 1350° C., less than 1.2 atomic percent silicon will form a solution with molybdenum.

The resultant Mo—Si—B solid composite is different from the prior art in that it is free of the equilibrium phase constraints imposed by simultaneously heating all the starting material to a high temperature, for example 1600° C. or greater. The resultant material of the process described in FIG. 2 is characterized by a continuous phase of pure molybdenum surrounding select intermetallics of A15 and T2. The silicon concentration in the $Mo_{ss}$ is minimized. The resulting material has strength and oxidation resistance at high temperature while exhibiting good ductility. The process allows for tailored compositions of Mo—Si—B. Among other things, separately forming A15 and T2 allows for control of grain growth and particles size of these intermetallics. The components, A15, T2, and molybdenum may be combined in any beneficial ratio.

Using the described process the envisioned composites include molybdenum matrix representing between about 50% and about 65% by volume the balance of the composite being composed of A15 and T2 in a ratio of A15 to T2 of about 0.5 to about 3.5 on a volume basis.

Ratios of the three phases may be varied throughout a fabricated article to form a gradient. For example an article may be fabricated to include more A15 and/or T2 at the surface and less toward the center. This may be accomplished through spraying various lay ers of material characterized by different concentrations of A15, T2, and molybdenum onto an article. Other methods are possible.

Figure 4:
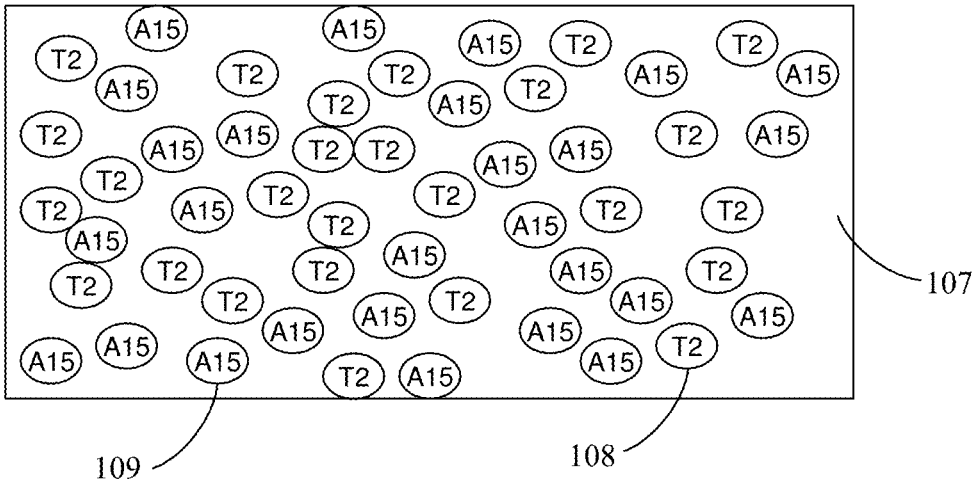
FIG. 4 is a schematic or notional representation of molybdenum composite fabricated using the described process.

FIG. 4 is a schematic or notional representation of molybdenum composite fabricated using the described process. An essentially continuous matrix of molybdenum 107 surrounds intermetallic particles of T2 and A15, elements 108 and 109 as shown in FIG. 4.

Figure 5:
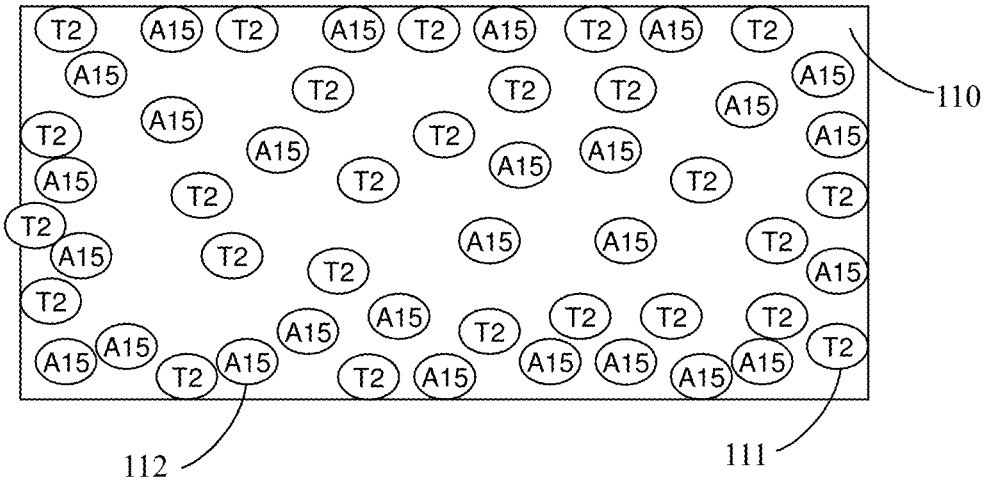
FIG. 5 is schematic or notional representation of a layered composite fabricated using the described process.

FIG. 5 is a schematic or notional representation of a layered composite fabricated using the described process. A continuous matrix of molybdenum 110 and a heavy concentration of T2 and A15, elements 111 and 112 are shown near the exterior surface with a reduced concentration of T2 and A15 toward the center. In this embodiment a higher concentration of T2 and A15 toward the exterior surface will promote oxygen resistance at the surface while a reduced concentration at the center of the composite will promote improved ductility.

Beneficial Additions

Figure 6:
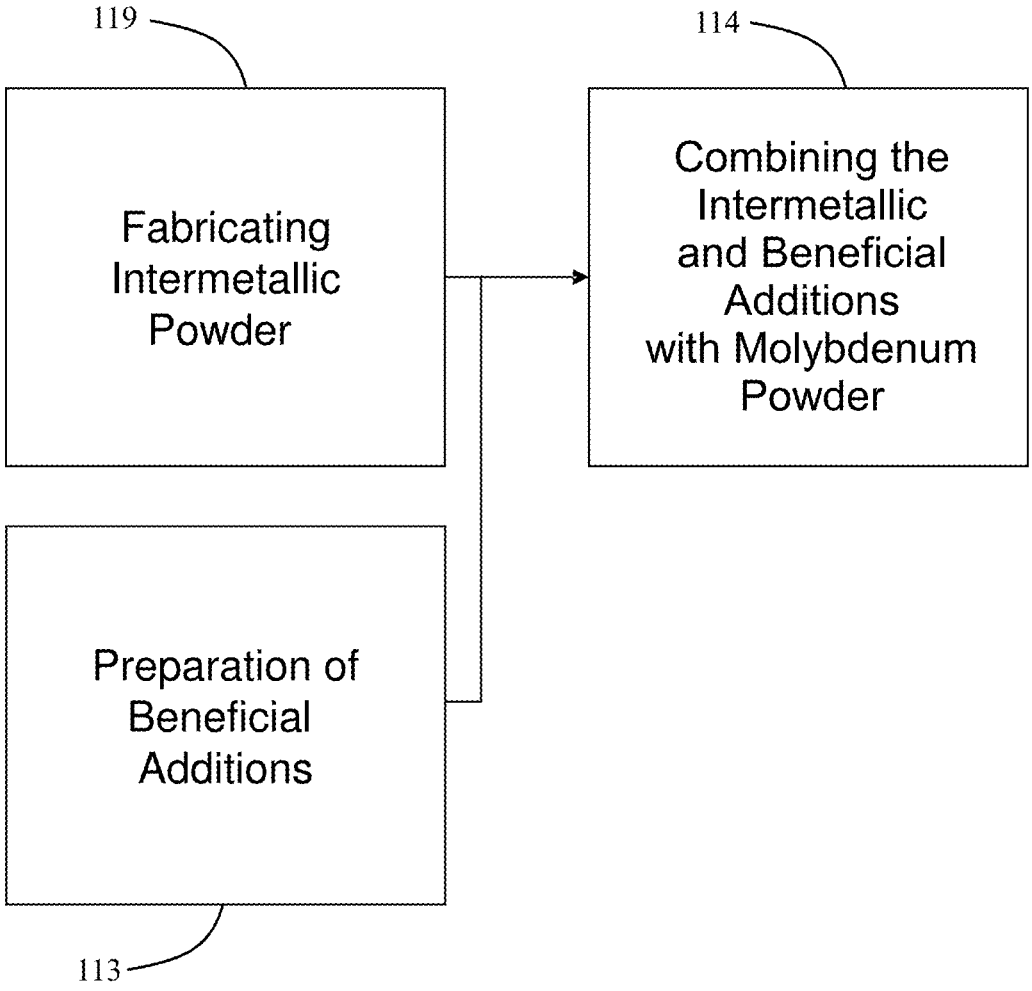
FIG. 6 shows molybdenum combined with beneficial additions.

In another embodiment as shown in FIG. 6, intermetallics 119, beneficial additives 113 are combined with molybdenum powder. In certain preferred embodiments, it is advantageous to add a reactive element such as titanium, zirconium, hafnium, and/or aluminum to the alloy to: (1) promote wetting of the borosilicate layer once it has formed, (2) raise the melting point of the borosilicate, (3) form a more refractory oxide layer below the initial borosilicate layer further impeding oxygen transport to the molybdenum matrix (4) strengthen the composite.

Envisioned additives include but are not limited to: Al, C, Cr, Hf, Ir, Mo, Nb, Os, Re, Rh, Ru, Si, Ta, Ti, V, W, Zr, compositions thereof including but not limited to oxides, nitrides and carbides. Additional additives include fluxing agents including but not limited to, Na, Ca, Mg, Sr, Ba, Pd, Zn, and compositions thereof compositions thereof including but not limited to oxides, nitrides and carbides. In one embodiment, select transition metals are incorporated including, but not limited to, Sc, Mn, Fe, Co. Ni, Cu, Zn and compositions thereof including but not limited to oxides, nitrides and carbides.

Other potential additives include selections from the alkali metals, alkaline earth metals, post transition metals, lanthanides, actinides, metalloids, and non-metals. Manganese added in small amounts of less than about 2 atomic percent, about 0.5 to about 1.5 atomic percent, of the composite have been shown to improve the overall all oxidation resistance of the Mo—Si—B composition. Adding an alkaline earth aluminosilicate such as strontium aluminosilicate ($1SrO\text{-}1Al_2O_3\text{-}2SiO_2$) in an amount less than about 2 volume percent, about 0.25 to about 1.75 volume percent, of the total composite or in combination with (Mn) has demonstrated good oxidation resistance.

Figure 7:
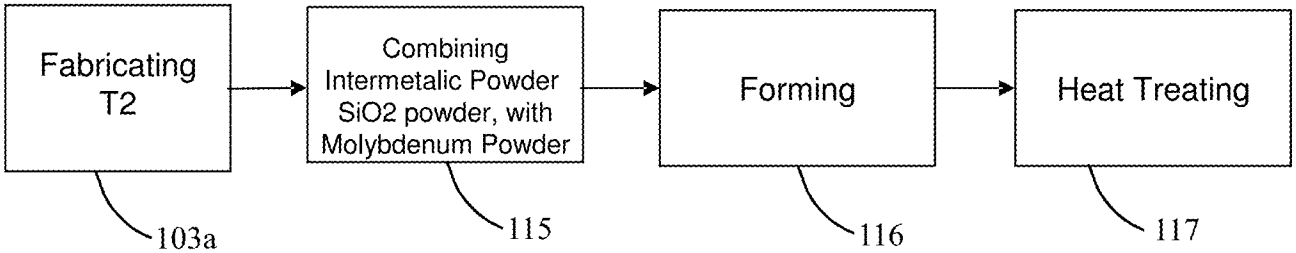
FIG. 7 is a block diagram illustrating the combining process of T2, $SiO_2$, and molybdenum powders.
Figure 8:
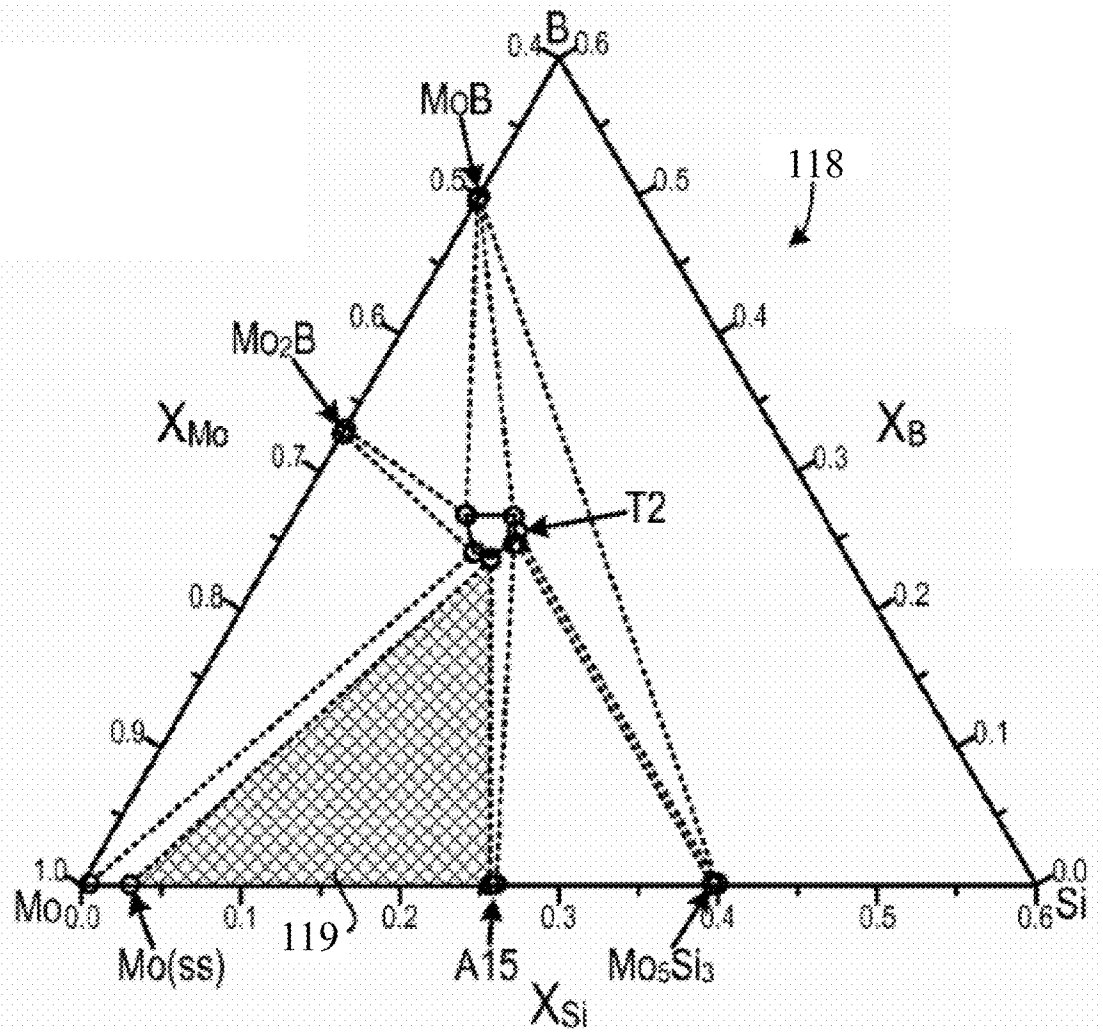
FIG. 8 is a portion of a ternary phase diagram for molybdenum, boron, and silicon at 1600° C.

Another preferred embodiment is shown in the process of FIG. 7. This process is essentially identical to the process described in FIG. 2 except that A15 is replaced by $SiO_2$.

In the combining process of FIG. 7, T2, $SiO_2$, and molybdenum powders are combined in step 115. This composition may be ball milled to break up agglomerates. The powder may be mixed with a liquid (such as water, acetone, or other organic or inorganic liquid) to form a suspension. An organic dispersant and binder, such as a methyl methacrylate copolymer, may be added to the suspension. A lubricant, such as stearic acid, may also be added to the suspension. The suspension may be spray dried to form a homogenous powder mixture.

The spray dried powder may be pressed to form a shape in step 116 and sintered and Hot Isostatic Pressed in step 117. Temperatures below 1400° C., preferably at or below 1300° C., will reduce the silicon concentration in the $Mo_{ss}$ present.

In the Mo—Si—B system, the A15 phase provides silicon to form silica coating when exposed to high temperature. However A15 is a source of silicon to form $Mo_{ss}$ because it is silica and not silicon which is ultimately desired, the introduction of silica ab initio into the microstructure will allow the formation of a protective scale while avoiding the presence of the A15 and thus alleviating the formation of $Mo_{ss}$. In addition to $SiO_2$ other beneficial additions may be included as described in FIG. 6.

Figure 9:
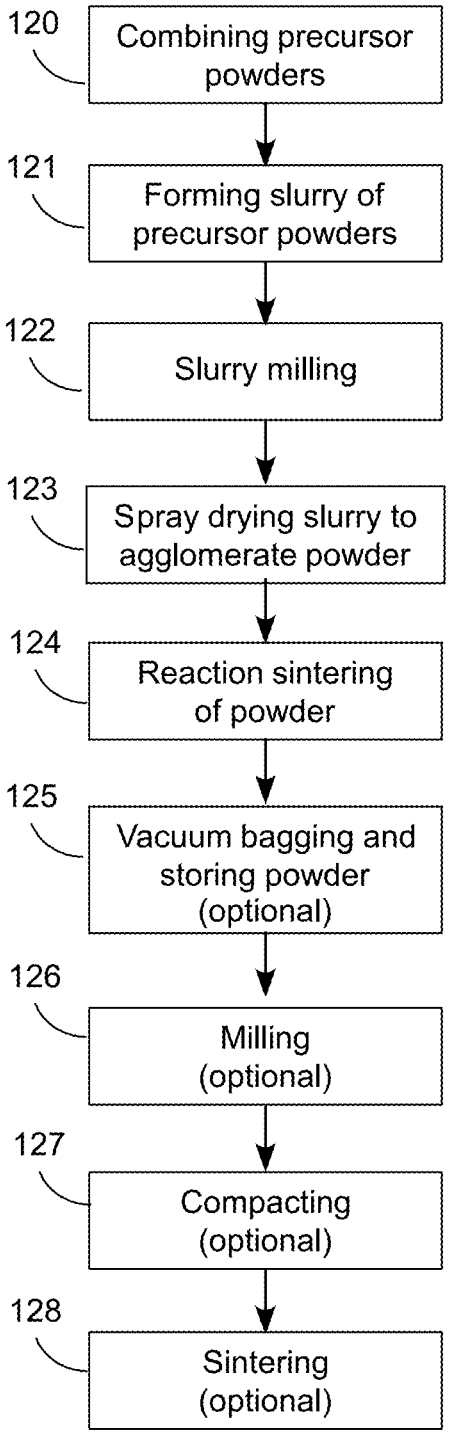
FIG. 9 is a block diagram illustrating the fabrication steps for producing a high density part.

FIG. 9 shows one method for producing Mo—Si—B with reduced silicon content in the $Mo_{ss}$ phase. It comprises of the steps of forming Mo—Si—B powder. Optionally the powder may be compacted and sintered to from a part or slug Step 120 comprises combining precursor powders which when heated will react to form Mo—Si—B. These submicron powders include, but are not limited to: boron nitride (BN), silicon nitride ($Si_3N_4$), and molybdenum. These powders are added in such a ratio as to form beneficial amounts of T2 and A15 in a continuous matrix of molybdenum. T2 and A15 are formed in the presence of heat via the following reactions:

$$\text{T2: } 5Mo + \frac{1}{3}Si_3N_4 + 2BN \rightarrow Mo_5SiB_2 + \frac{5}{3}N_2$$

$$\text{A15: } 3Mo + \frac{1}{3}Si_3N_4 \rightarrow Mo_3Si + \frac{2}{3}N_2$$

Other additives may be included in this step. Additives known in the prior art may be included to: promote wetting of the borosilicate layer once it has formed, raise the melting point of the borosilicate, form a more refractory oxide layer below the initial borosilicate layer further impeding oxygen transport to the molybdenum matrix, and strengthen the composite.

Step 121 comprises forming a slurry. The precursor powders of Step 120 are dispersed or dissolved in a liquid (such as acetone, or other organic liquid) to form a suspension. An organic dispersant and binder, such as a methyl methacrylate copolymer, may be added to the suspension. A lubricant, such as stearic acid, may also be added to the suspension.

Step 122 comprises milling the suspension to break up agglomerates of the boron nitride powder, the silicon nitride powder, and the molybdenum powder.

Step 123 comprises spray drying the slurry to form a homogenous powder mixture.

Step 124 comprises reaction sintering the homogenous powder in a reducing atmosphere, including but not limited to, hydrogen at a temperature at least below about 1400° C. more preferably below about 1350° C. and even more preferably below about 1300° C. The resulting powder consists essentially of phases: T2, A15 and only trace amounts of silicon in the $Mo_{ss}$. When fired at about 1400° C. there is 2% or fewer atoms of silicon in the $Mo_{ss}$ phase. When fired at about 1300° C. there is about 1.2% or fewer atoms of silicon in the $Mo_{ss}$ phase.

Step 125 comprises storing the material in oxygen free atmosphere. At this stage, care should be taken to limit the exposure of this material to air. The high surface area of the powder is susceptible to oxidation. Viable storage methods include, but are not limited to, vacuum bagging.

Step 126 comprises optionally milling the powder to break up large agglomerates formed as a result of sintered necks at particle-particle contact points.

Optionally, a part or slug may be formed from the powder using standard powder processing methods. These include, but are not limited to, Step 127 and Step 128.

Step 127 comprises optionally compacting the powder. This may be completed in an inert atmosphere. Potential compacting methods include cold isostatic pressing at above about 10,000 psi and temperatures below about 200° C. Vibratory methods may also be used to compact the powder into a mold or form.

Step 128 comprises optionally sintering the powder in an inert or reducing environment at a temperature below about 1400° C. more preferably below about 1350° C. and even more preferably below about 1300° C. To achieve a dense part, it is desirable to sinter under a pressure of about 10,000 psi or greater with a more preferable pressure of about 50,000 psi. The resulting sintered part is at least 98% of the 100% theoretical density and has substantially reduced silicon in the $Mo_{ss}$ phase. When fired at about 1400° C. there is 2% or less atoms of silicon in the $Mo_{ss}$ phase. When fired at 1300° C. there is about 1.2% or less atoms of silicon in the $Mo_{ss}$ phase.

Figure 10:
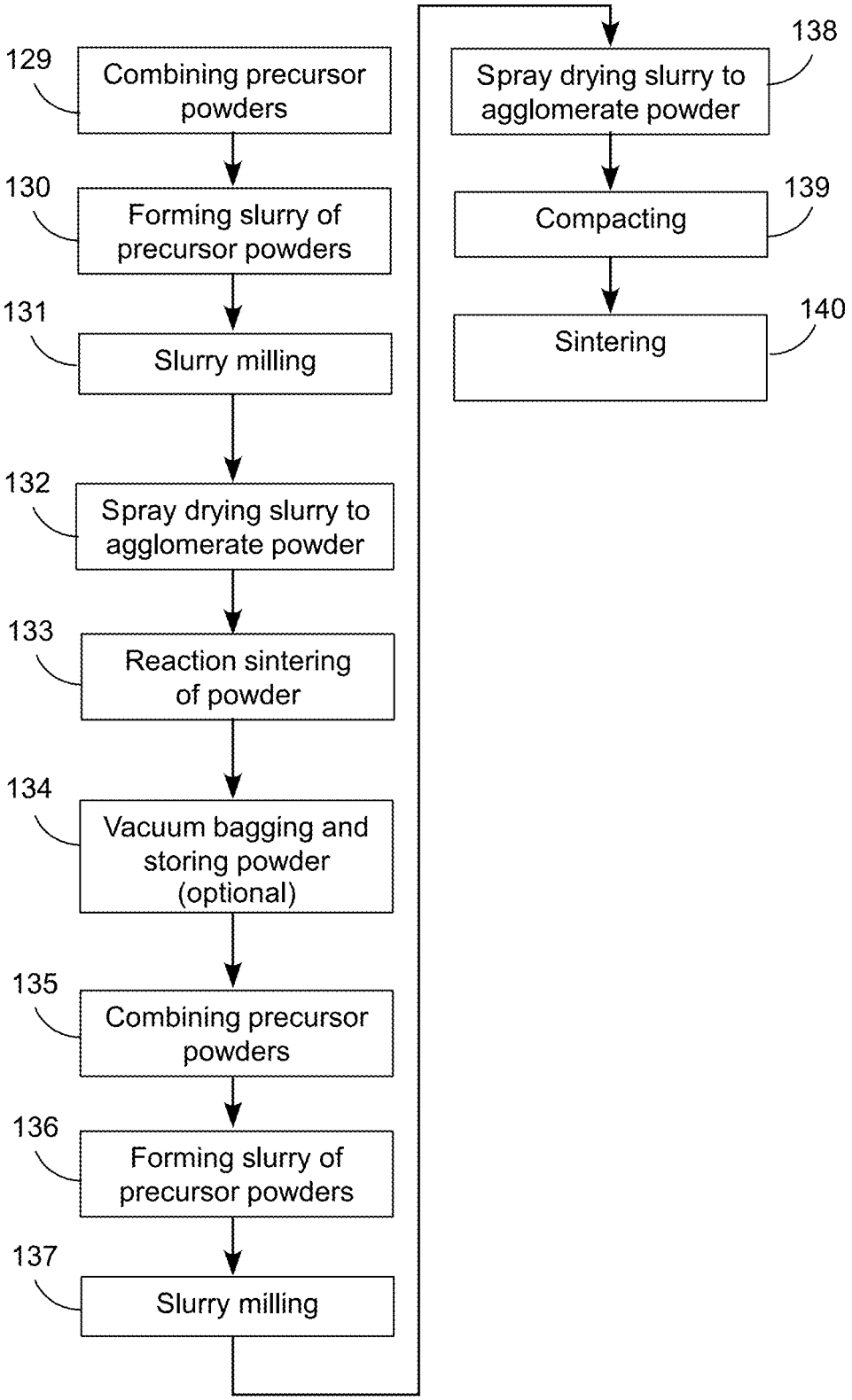
FIG. 10 is an alternate block diagram illustrating another embodiment of the fabrication steps for producing a high density part.

FIG. 10 shows another method for producing Mo—Si—B with reduced silicon content in the $Mo_{ss}$ phase. It comprises of the steps of forming Mo—Si—B powder. Optionally the powder may be compacted and sintered to from a part or slug Step 129 comprises combining precursor powders which when heated will react to form Mo—Si—B. These submicron powders include, but are not limited to: boron nitride (BN), silicon nitride ($Si_3N_4$), and molybdenum. These powders are added in such a ratio as to form beneficial amounts of T2 and A15. T2 and A15 are formed in the presence of heat via the following reactions:

$$\text{T2: } 5Mo + \frac{1}{3}Si_3N_4 + 2BN \rightarrow Mo_5SiB_2 + \frac{5}{3}N_2$$

$$\text{A15: } 3Mo + \frac{1}{3}Si_3N_4 \rightarrow Mo_3Si + \frac{2}{3}N_2$$

Other additives may be included in this step. Additives known in the prior art may be included to: promote wetting of the borosilicate layer once it has formed; raise the melting point of the borosilicate; form a more refractory oxide layer below the initial borosilicate layer further impeding oxyg en transport to the molybdenum matrix; and strengthen the composite.

Step 130 comprises forming a slurry. The precursor powders of Step 129 are dispersed or dissolved in a liquid (such as acetone, or other organic liquid) to form a suspension. An organic dispersant and binder, such as a methyl methacrylate copolymer, may be added to the suspension. A lubricant, such as stearic acid, may also be added to the suspension.

Step 131 comprises milling the suspension to break up agglomerates of the boron nitride powder, the silicon nitride powder, and the molybdenum powder.

Step 132 comprises spray drying the slurry to form a homogenous powder mixture.

Step 133 comprises reaction sintering the homogenous powder in a reducing atmosphere, including but not limited to, hydrogen at a temperature at least below about 1400° C. more preferably below about 1350° C. and even more preferably below about 1300° C. The resulting powder consists essentially of phases: T2, A15 and only trace amounts of silicon in the $Mo_{ss}$. When fired at 1 about 400° C. there is 2% or fewer atoms of silicon in the $Mo_{ss}$ phase. When fired at about 1300° C. there is about 1.2% or fewer atoms of silicon in the $Mo_{ss}$ phase.

Step 134 comprises storing the material in oxygen free atmosphere. At this stage, care should be taken to limit the exposure of this material to air. The high surface area of the powder is susceptible to oxidation. Viable storage methods include, but are not limited to, vacuum bagging.

Step 135 comprises combining precursor powders from step 134 with additional precursor powders which when heated will react to form Mo—Si—B. These submicron powders include, but are not limited to: A15, T2, boron nitride (BN), silicon nitride ($Si_3N_4$), and molybdenum. These powders are added in such a ratio as to form beneficial amounts of T2 and A15 in a continuous matrix of molybdenum.

Other additives may be included in this step. Additives known in the prior art may be included to: promote wetting of the borosilicate layer once it has formed; raise the melting point of the borosilicate; form a more refractory oxide layer below the initial borosilicate layer further impeding oxygen transport to the molybdenum matrix; and strengthen the composite.

Step 136 comprises forming a slurry. The precursor powders of Step 135 are dispersed or dissolved in a liquid (such as acetone, or other organic liquid) to form a suspension. An organic dispersant and binder, such as a methyl methacrylate copolymer, may be added to the suspension. A lubricant, such as steari c acid, may also be added to the suspension.

Step 137 comprises milling the suspension to break up agglomerates of the A15 powder, the T2 powder, the boron nitride powder, the silicon nitride powder, and the molybdenum powder.

Step 138 comprises spray drying the slurry to form a homogenous powder mixture.

Optionally, a part or slug may be formed from the powder using standard powder processing methods. These include, but are not limited to, Step 139 and Step 140.

Step 139 comprises optionally compacting the powder. This may be completed in an inert atmosphere. Potential compacting methods include cold isostatic pressing at above about 10,000 psi and temperatures below about 200° C. Vibratory methods may also be used to compact the powder into a mold or form.

Step 140 comprises optionally sintering the powder in an inert or reducing environment at a temperature below about 1400° C. more preferably below about 1350° C. and even more preferably below about 1300° C. To achieve a dense part, it is desirable to sinter under a pressure of about 10,000 psi or greater with a more preferable pressure of about 50,000 psi. The resulting sintered part is at least 98% of the 100% theoretical density and has substantially reduced silicon in the $Mo_{ss}$ phase. When fired at about 1400° C. there is 2% or less atoms of silicon in the $Mo_{ss}$ phase. When fired at 1300° C. there is about 1.2% or less atoms of silicon in the $Mo_{ss}$ phase.

Figure 11:
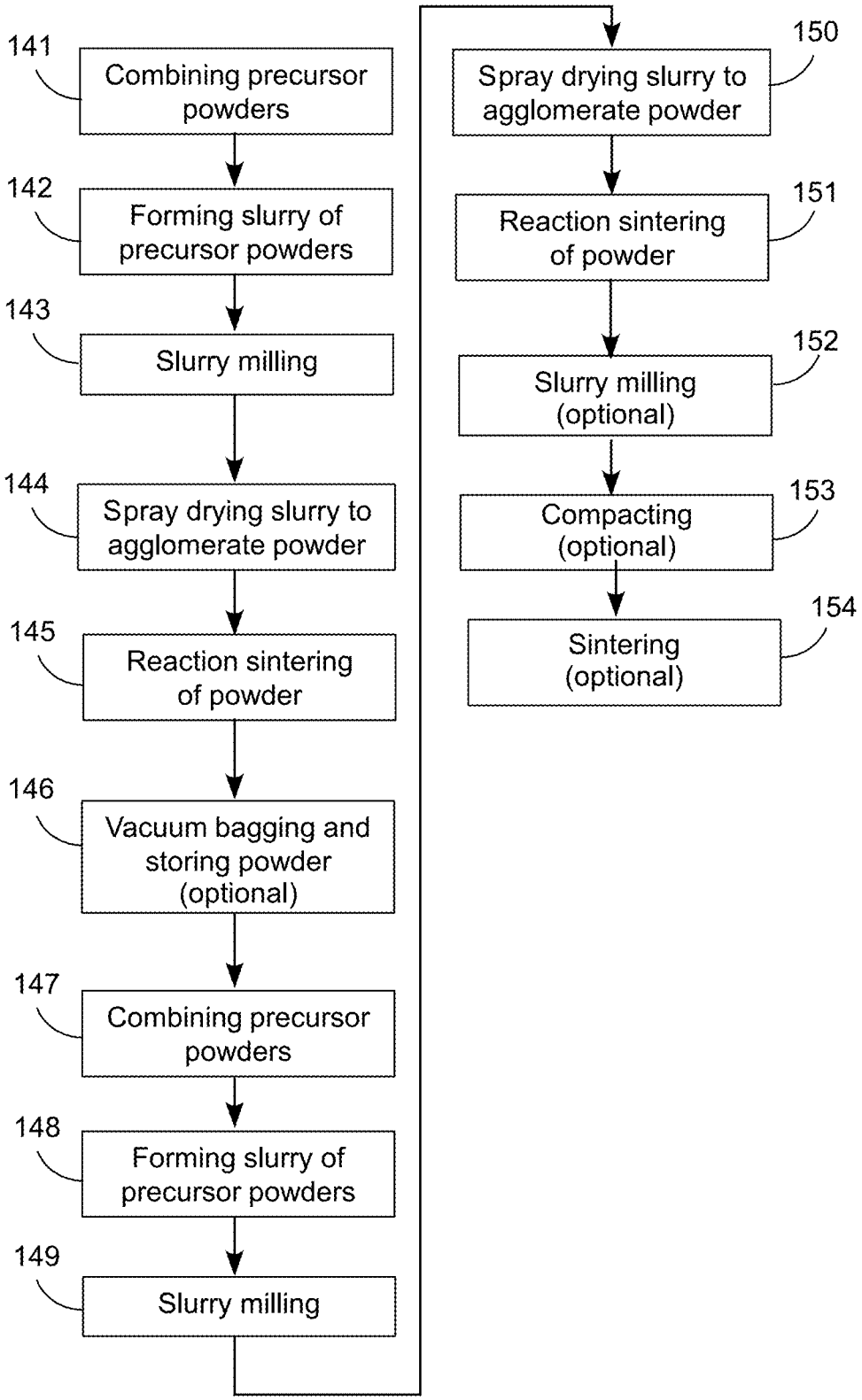
FIG. 11 is an alternate block diagram illustrating another embodiment of the fabrication steps for producing a high density part

FIG. 11 shows another method for producing Mo—Si—B with reduced silicon content in the $Mo_{ss}$ phase. It comprises of the steps of forming Mo—Si—B powder. Optionally the powder may be compacted and sintered to from a part or slug Step 141 comprises combining precursor powders which when heated will react to form Mo—Si—B. These submicron powders include, but are not limited to: boron nitride (BN), silicon nitride ($Si_3N_4$), and molybdenum. These powders are added in such a ratio as to form beneficial amounts of T2 and A15. T2 and A15 are formed in the presence of heat via the following reactions:

$$\text{T2: } 5Mo + \frac{1}{3}Si_3N_4 + 2BN \rightarrow Mo_5SiB_2 + \frac{5}{3}N_2$$

$$\text{A15: } 3Mo + \frac{1}{3}Si_3N_4 \rightarrow Mo_3Si + \frac{2}{3}N_2$$

Other additives may be included in this step. Additives known in the prior art may be included to: promote wetting of the borosilicate layer once it has formed; raise the melting point of the borosilicate; form a more refractory oxide layer below the initial borosilicate layer further impeding oxygen transport to the molybdenum matrix; and strengthen the composite.

Step 142 comprises forming a slurry. The precursor powders of Step 129 are dispersed or dissolved in a liquid (such as acetone, or other organic liquid) to form a suspension. An organic dispersant and binder, such as a methyl methacrylate copolymer, may be added to the suspension. A lubricant, such as stearic acid, may also be added to the suspension.

Step 143 comprises milling the suspension to break up agglomerates of the boron nitride powder, the silicon nitride powder, and the molybdenum powder.

Step 144 comprises spray drying the slurry to form a homogenous powder mixture.

Step 145 comprises reaction sintering the homogenous powder in a reducing atmosphere, including but not limited to, hydrogen at a temperature at least below about 1400° C. more preferably below about 1350° C. and even more preferably below about 1300° C. The resulting powder consists essentially of phases: T2, A15 and only trace amounts of silicon in the $Mo_{ss}$. When fired at 1 about 400° C. there is 2% or fewer atoms of silicon in the $Mo_{ss}$ phase. When fired at about 1300° C. there is about 1.2% or fewer atoms of silicon in the $Mo_{ss}$ phase.

Step 146 comprises storing the material in oxygen free atmosphere. At this stage, care should be taken to limit the exposure of this material to air. The high surface area of the powder is susceptible to oxidation. Viable storage methods include, but are not limited to, vacuum bagging.

Step 147 comprises combining precursor powders from step 146 with additional precursor powders which when heated will react to form Mo—Si—B. These submicron powders include, but are not limited to: A15, T2, boron nitride (BN), silicon nitride ($Si_3N_4$), and molybdenum. These powders are added in such a ratio as to form beneficial amounts of T2 and A15 in a continuous matrix of molybdenum.

Other additives may be included in this step. Additives known in the prior art may be included to: promote wetting of the borosilicate layer once it has formed; raise the melting point of the borosilicate; form a more refractory oxide layer below the initial borosilicate layer further impeding oxygen transport to the molybdenum matrix; and strengthen the composite.

Step 148 comprises forming a slurry. The precursor powders of Step 135 are dispersed or dissolved in a liquid (such as acetone, or other organic liquid) to form a suspension. An organic dispersant and binder, such as a methyl methacrylate copolymer, may be added to the suspension. A lubricant, such as stearic acid, may also be added to the suspension.

Step 149 comprises milling the suspension to break up agglomerates of the A15 powder, the T2 powder, the boron nitride powder, the silicon nitride powder, and the molybdenum powder.

Step 150 comprises spray drying the slurry to form a homogenous powder mixture.

Step 151 comprises sintering the powder in an inert or reducing environment at a temperature below about 1400° C. more preferably below about 1350° C. and even more preferably below about 1300° C. To achieve a dense part, it is desirable to sinter under a pressure of about 10,000 psi or greater with a more preferable pressure of about 50,000 psi. The resulting sintered part is at least 98% of the 100% theoretical density and has substantially reduced silicon in the $Mo_{ss}$ phase. When fired at about 1400° C. there is 2% or less atoms of silicon in the $Mo_{ss}$ phase. When fired at 1300° C. there is about 1.2% or less atoms of silicon in the $Mo_{ss}$ phase.

Optionally, a part or slug may be formed from the powder using standard powder processing methods. These include, but are not limited to, Step 152, Step 153 and Step 154.

Step 152 comprises milling the suspension to break up agglomerates of the reacted Mo—Si—B powder.

Step 153 comprises optionally compacting the powder. This may be completed in an inert atmosphere. Potential compacting methods include cold isostatic pressing at above about 10,000 psi and temperatures below about 200° C. Vibratory methods may also be used to compact the powder into a mold or form.

Step 154 comprises optionally sintering the powder in an inert or reducing environment at a temperature below about 1400° C. more preferably below about 1350° C. and even more preferably below about 1300° C. To achieve a dense part, it is desirable to sinter under a pressure of about 10,000 psi or greater with a more preferable pressure of about 50,000 psi. The resulting sintered part is at least 98% of the 100% theoretical density and has substantially reduced silicon in the $Mo_{ss}$ phase. When fired at about 1400° C. there is 2% or less atoms of silicon in the $Mo_{ss}$ phase. When fired at 1300° C. there is about 1.2% or less atoms of silicon in the $Mo_{ss}$ phase.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. The process of forming a molybdenum silicon boride reacted high density composite part which comprises:

a. forming a slurry of molybdenum, silicon oxide, silicon nitride, boron nitride, and a liquid;
b. spray drying the slurry to form a homogenous, unreacted powder mixture;
c. reacting the homogeneous powder mixture in a reducing atmosphere at an elevated temperature to form a three phase composite powder of $Mo_{ss}$, silicon oxide and T2 ($Mo_5SiB_2$), in which the $Mo_{ss}$ contains less than about 3 atomic percent silicon in solution in equilibrium with the T2;
d. compacting the reacted composite powder; and
e. sintering the compacted reacted composite powder at an elevated temperature and pressure to form a reacted high density composite part.

2. The process of claim 1 in which the reacted high density composite part has a volume percent of about 50% to about 65% Moss, the balance of the high density composite part being composed of silicon oxide and T2 in a ratio of silicon oxide to T2 of about 0.5 to about 3.5 on a volume basis.

3. The process of claim 1 in which one or more additives is included in the powders forming the slurry.

4. The process of claim 3 in which at least one additive is manganese in an amount less than about 2 atomic percent of the total composite.

5. The process of claim 4 in which at least one additive is manganese in an amount of about 0.5 to about 1.5 atomic percent of the total composite.

6. The process of claim 3 in which at least one additive is an alkaline earth aluminosilicate in an amount less than about 2 volume percent of the total composite.

7. The process of claim 6 in which at least one additive is an alkaline earth aluminosilicate in an amount of about 0.25 to about 1.75 volume percent of the total composite.

8. The process of claim 6 wherein the alkaline earth aluminosilicate is strontium aluminosilicate.

9. The process of claim 1 wherein the Moss in the reacted composite powder contains less than 1.5 atomic percent silicon in solution in equilibrium with the T2.

10. The process of claim 1 wherein the silicon nitride is $Si_3N_4$ and the boron nitride is BN.

11. The process of forming a molybdenum silicon boride reacted high density composite part which comprises:

a. forming a slurry of molybdenum, silicon oxide, silicon nitride, boron nitride, and a liquid;
b. spray drying the slurry to form a homogenous, unreacted powder mixture;
c. compacting the reacted composite powder; and
d. reacting the homogeneous powder mixture in a reducing atmosphere at an elevated temperature to form a three phase composite powder of $Mo_{ss}$, silicon oxide and T2 ($Mo_5SiB_2$), in which the $Mo_{ss}$ contains less than about 3 atomic percent silicon in solution in equilibrium with the T2;

e. sintering the compacted reacted composite powder at an elevated temperature and pressure to form a reacted high density composite part.

12. The process of claim 11 in which the reacted high density composite part has a volume percent of about 50% to about 65% Moss, the balance of the high density composite part being composed of silicon oxide and T2 in a ratio of silicon oxide to T2 of about 0.5 to about 3.5 on a volume basis.

13. The process of claim 11 in which one or more additives is included in the powders forming the slurry.

14. The process of claim 13 in which at least one additive is manganese in an amount less than about 2 atomic percent of the total composite.

15. The process of claim 14 in which at least one additive is manganese in an amount of about 0.5 to about 1.5 atomic percent of the total composite.

16. The process of claim 13 in which at least one additive is an alkaline earth aluminosilicate in an amount less than about 2 volume percent of the total composite.

17. The process of claim 16 in which at least one additive is an alkaline earth aluminosilicate in an amount of about 0.25 to about 1.75 volume percent of the total composite.

18. The process of claim 16 wherein the alkaline earth aluminosilicate is strontium aluminosilicate.

19. The process of claim 11 wherein the Moss in the reacted composite powder contains less than 1.5 atomic percent silicon in solution in equilibrium with the T2.

20. The process of claim 11 wherein the silicon nitride is $Si_3N_4$ and the boron nitride is BN.

* * * * *